US009151044B2

(12) United States Patent
Krapf et al.

(10) Patent No.: US 9,151,044 B2
(45) Date of Patent: Oct. 6, 2015

(54) PANEL MOUNTING APPARATUS AND RELATED METHOD OF MANUFACTURE

(71) Applicant: INTELLIPROPLIST LLC, Macedon, NY (US)

(72) Inventors: Wallace A. Krapf, Macedon, NY (US); Christian Q. Krapf, Rochester, NY (US); Artem G. Sivak, Rochester, NY (US)

(73) Assignee: Intelliproplist LLC, Macedon, NY (US)

( * ) Notice: Subject to any disclaimer, the term of this patent is extended or adjusted under 35 U.S.C. 154(b) by 0 days.

(21) Appl. No.: 14/043,441

(22) Filed: Oct. 1, 2013

(65) Prior Publication Data

US 2014/0123584 A1 May 8, 2014

Related U.S. Application Data

(60) Provisional application No. 61/708,940, filed on Oct. 2, 2012.

(51) Int. Cl.

| | |
|---|---|
| ***B43L 1/00*** | (2006.01) |
| ***A47B 97/00*** | (2006.01) |
| ***E04B 2/56*** | (2006.01) |
| ***E04B 2/10*** | (2006.01) |
| ***E04B 2/00*** | (2006.01) |
| ***A47B 96/20*** | (2006.01) |

(52) U.S. Cl.

CPC ..... *E04B 2/562* (2013.01); *A47B 96/20* (2013.01); *A47B 97/00* (2013.01); *B43L 1/00* (2013.01); *B43L 1/008* (2013.01); *E04B 2/10* (2013.01); *E04C 2/46* (2013.01); *Y10T 29/49629* (2015.01)

(58) Field of Classification Search

CPC ..... B43L 1/00; B43L 1/008; B43L 1/06; B43L 1/10; B43L 1/04; B43L 1/045; A47B 97/00; A47B 97/001

USPC ..... 52/712, 713, 714, 715, 483.1, 489.1, 52/489.2, 506.06, 506.09, 510, 511, 512, 52/775, 779, 781; 211/87.01, 32, 35, 45, 211/48; 40/124.01, 124.04, 661.08, 661.11

See application file for complete search history.

(56) References Cited

U.S. PATENT DOCUMENTS

| | | | | |
|---|---|---|---|---|
| 2,521,134 | A * | 9/1950 | Stanitz | 211/72 |
| 3,950,049 | A * | 4/1976 | Drass | 312/245 |
| 4,311,295 | A * | 1/1982 | Jamar, Jr. | 248/222.11 |
| 4,621,471 | A * | 11/1986 | Kuhr et al. | 52/288.1 |
| 5,224,610 | A * | 7/1993 | Veazey | 211/87.01 |
| 5,384,999 | A * | 1/1995 | Roche et al. | 52/764 |
| 5,657,885 | A * | 8/1997 | White et al. | 211/87.01 |
| 6,490,828 | B1 * | 12/2002 | Volesky et al. | 52/36.1 |
| 6,508,449 | B2 * | 1/2003 | Veazey | 248/475.1 |
| 6,547,086 | B1 * | 4/2003 | Harvey | 211/87.01 |
| 6,620,500 | B2 | 9/2003 | Sweet et al. | |
| 7,985,472 | B2 | 7/2011 | Outlaw et al. | |
| 8,042,308 | B2 * | 10/2011 | Sullivan et al. | 52/238.1 |
| 8,739,983 | B2 * | 6/2014 | Sugarman | 211/85.7 |
| 2011/0025180 | A1 * | 2/2011 | Ilich et al. | 312/237 |

* cited by examiner

*Primary Examiner* — Jessica Laux
(74) *Attorney, Agent, or Firm* — Barclay Damon, LLP

(57) ABSTRACT

A wall panel assembly includes at least one panel made from a steel sheet having a plurality of rear extending lateral edge flanges forming an enclosure and including a front surface. A cleat disposed within the formed enclosure includes a cleat body having a slot that is engageable with a support structure that is fixedly attachable to a wall. The support structure includes a plurality of engagement members that are releasably engageable in the at least one slot of the cleat. The support structure can be formed from a series of linear interconnectable sections.

7 Claims, 12 Drawing Sheets

PANEL MOUNTING APPARATUS AND RELATED METHOD OF MANUFACTURE

CROSS REFERENCE TO RELATED APPLICATION

This application claims priority under relevant portions of 35 U.S.C. §119 to U.S. Application Ser. No. 61/708,940, entitled: PANEL MOUNTING APPARATUS AND RELATED METHOD OF MANUFACTURE, filed Oct. 18, 2012, the entire contents of which are herein incorporated by reference.

TECHNICAL FIELD

The application generally relates to the field of display systems and more particularly to a panel having a dry-erase surface that is attachable to an assembly support, and wherein the assembly support enables a single panel or a plurality of panels to be releasably attached to a wall or wall-like structure.

BACKGROUND

Applicants presently manufacture and market various display boards, some of which are defined by steel dry-erase surfaces that further support magnets in combination therewith for tracking, calendaring, scheduling and other purposes. These display boards have been found to be superior and more versatile, as compared to conventional blackboards for the above purposes. Certain versions have included portable boards that are self-supporting, as well as larger dry-erase display boards having dedicated frame or supporting structures.

A growing need in the field now exists for larger display boards that can effectively be mounted to existing wall surfaces. The conventional method at least partially satisfying this need is to provide panels that are adhesively attached directly to wall surfaces. Though effective and preferred in certain situations due to the dry-erase features of these panels, adhesive mounting is permanent and does not easily permit modification or adjustability. In that regard, certain purchasers have become desirous of an assembly that enables enhanced versatility by permitting display panels to be releasably attached to a wall surface.

SUMMARY

According to one version, there is provided a wall panel assembly comprising at least one wall panel comprising a steel sheet having a front surface and rear extending side edge flanges forming an enclosure and a cleat which is fitted within said formed enclosure, said cleat including at least one longitudinal slot; and a support having means for enabling said support to be fixedly attached to a wall surface, said support including a plurality of spaced engagement members engageable in said at least one longitudinal slot of said at least one wall panel.

According to one version, the engagement members comprise a plurality of spaced tongues, which can be integral to the support. Preferably, the tongues are angled relative to the remainder of the support and aligned with the longitudinal slot, which is also angled to effectuate support of a panel when attached, the tongues being adequately spaced in order to provide a distributed load.

According to one version, the panel includes an intermediate core layer, including a pair of substrate sections that are sized to be secured within a portion of said formed enclosure and in which said cleat is disposed between the substrate sections. The cleat is secured between the substrate sections and according to one version can include at least one edge section for reinforcing the panel to prevent buckling.

In one version, the support structure can be an integrated section. In another version, the support structure can be defined by a plurality of interconnectable structure sections, thereby enabling selective expansion of the assembly, as needed, and permitting a plurality of panels to be releasably attached to a wall or wall-like structure. The panels are longitudinally or laterally movable, once assembled. based on the attachment between the tongues and the at least one slot, which extends along substantially the entire width dimension of the panel.

According to another version, the herein described support structure can be used to facilitate permanent mounting of at least one display panel to a wall or wall structure. The support structure lends itself to align and level at least one panel or a plurality of panels relative to one another and a wall structure as the panels are being adhesively mounted thereto.

According to another version, there is provided a wall panel comprising a steel sheet having a dry-erase front surface, a rear backing surface supported by said steel sheet and including at least one longitudinal slot disposed in the rear backing surface, said at least one slot being configured to releasably engage a wall structure. According to one version, the slot can be disposed within a cleat provided in either the rear backing surface or an intermediate layer of the panel. The cleat is configured for releasably receiving at least one engagement member from a support structure, the latter being fixedly attached to a wall or wall surface.

In at least one embodiment, the retention of the cleat within the slot enables a panel to be aligned with a support structure as attached to the wall or wall structure. This alignment facilitates overall assembly, whether the panels are permanently or releasably attached to the wall structure.

According to yet another version, there is provided a method for releasably attaching at least one panel to a wall or wall-like surface. The method can comprise providing a support structure having at least one planar support and a plurality of spaced tongues extending therefrom. Additionally, at least one panel is provided, the at least one panel including a rear backing surface and further including at least one longitudinal slot. The at least one slot is engaged with said tongues of the support structure, in which the support structure is fixedly attached to a wall or wall-like structure.

According to at least one version, a plurality of panels can be releasably attached to the support structure wherein the panels can be laterally shifted or otherwise repositioned over at least a predetermined distance while supported by the support structure or removed and repositioned thereon. In another version, the panels can be permanently attached to the wall or wall structure retaining the support structure and in which the support structure facilitates alignment of one or a plurality of panels attached thereto.

The support structure in at least one version can be assembled as a unitary component and/or can be formed of a plurality of interconnectable structure sections, enabling the overall assembly to be expanded as needed.

The panels can include a dry-erase front or facing surface according to at least one version or can be defined by a front surface having at least a portion that is defined with a dry-erase coating. In another version, the front surface can be formed with various features, including designs, maps, grids, markers and other designations. According to at least one version, the dry-erase surface enables the use of magnets and other attachments.

According to another aspect, there is described a method for manufacturing a panel assembly. This method comprises manufacturing at least one panel, wherein the panel manufacture includes the additional steps of providing a steel sheet, forming lateral side flanges in the steel sheet, forming an enclosure, securing an intermediate layer within the formed enclosure, the intermediate layer including at least two substrate sections, and positioning at least one cleat between the at least two substrate sections of the intermediate layer, the at least one cleat including a body having a longitudinal slot extending along the width dimension thereof. The method further comprises providing a support structure including at least one planar section configured for fixed attachment to a wall surface, and providing at least one engagement member extending from the at least one planar section of the support structure, the at least one engagement member being sized for engagement with the slot to enable releasable engagement with the panel.

In one version, the method further includes the step of providing at least a portion of a facing surface of the steel sheet with a dry-erase coating, such as a ceramic coating.

The at least one engagement member comprises a plurality of angled tongues according to one version, the tongues being sized, spaced and configured for engagement with the slot, and in which the slot is angled for receiving the tongues to permit distributed support of the at least one panel.

In one version, the plurality of tongues are integral to the planar section. In another version, the tongues or other engagement members can be separately attached to the support structure.

According to one version, the method includes the additional steps of providing a plurality of panels, wherein the panels are laterally adjustable while in an assembled position. To that end, the support structure can further comprises a plurality of planar sections that include features enabling linear interconnectability of the sections in order to permit expandability of an assembly.

The support structure can enable alignment of the panels as they are either releasably attached to the support structure and the wall or wall structure. The panels can also be aligned using the support structure for purposes of permanent fixation to the wall or wall structure.

One advantage that is realized by the herein described assembly is enhanced versatility in being able to mount dry-erase and other display boards to a wall or similar structure in releasable or permanent fashion.

In one version, the cleat can include a lateral reinforcing portion to prevent localized buckling of the panel. The lateral reinforcing portion can be integrated with the panel or can be otherwise provided.

Yet another advantage is that the overall assembly is fast and easy in terms of time and overall cost and in which the support structure improved versatility and enables universal assembly. A nearly limitless number of assembly combinations are possible.

Still another advantage is that the panels can be laterally shifted or positioned in relation to one another once attached to the support structure of the herein described assembly.

These and other features and advantages will become readily apparent from the following Detailed Description, which should be read in conjunction with the following drawings.

DETAILED DESCRIPTION

The following description relates to a preferred embodiment of at least one panel for releasable assembly to a wall or wall-like structure using a support adapter, including the assembly and manufacture of an exemplary panel. It will be apparent, as discussed herein, that numerous variations and modifications are possible including permanent fixation of at least one panel to a wall or wall surface having a surface adapter(s) mounted thereto. In addition and though a display panel having a steel dry-erase surface is herein discussed according to this embodiment, other panels can be constructed to include and/or support or retain additional features.

Various terms are herein used throughout the course of the discussion that follows in order to provide a suitable frame of reference in regard to the accompanying drawings. These terms, which include, for example, "upper", "lower", "inner", "outer", "top", "front", "rear" and the like are not intended to be overly limiting of the inventive concepts described herein, including the claims, except where so specifically indicated.

The drawings have been provided to provide a clear and sufficient detailing of the invention. However, it should be noted the drawings are not necessarily drawn to scale and therefore the drawings should not be narrowly interpreted in terms of dimensions depicted in this application.

Figure 1:
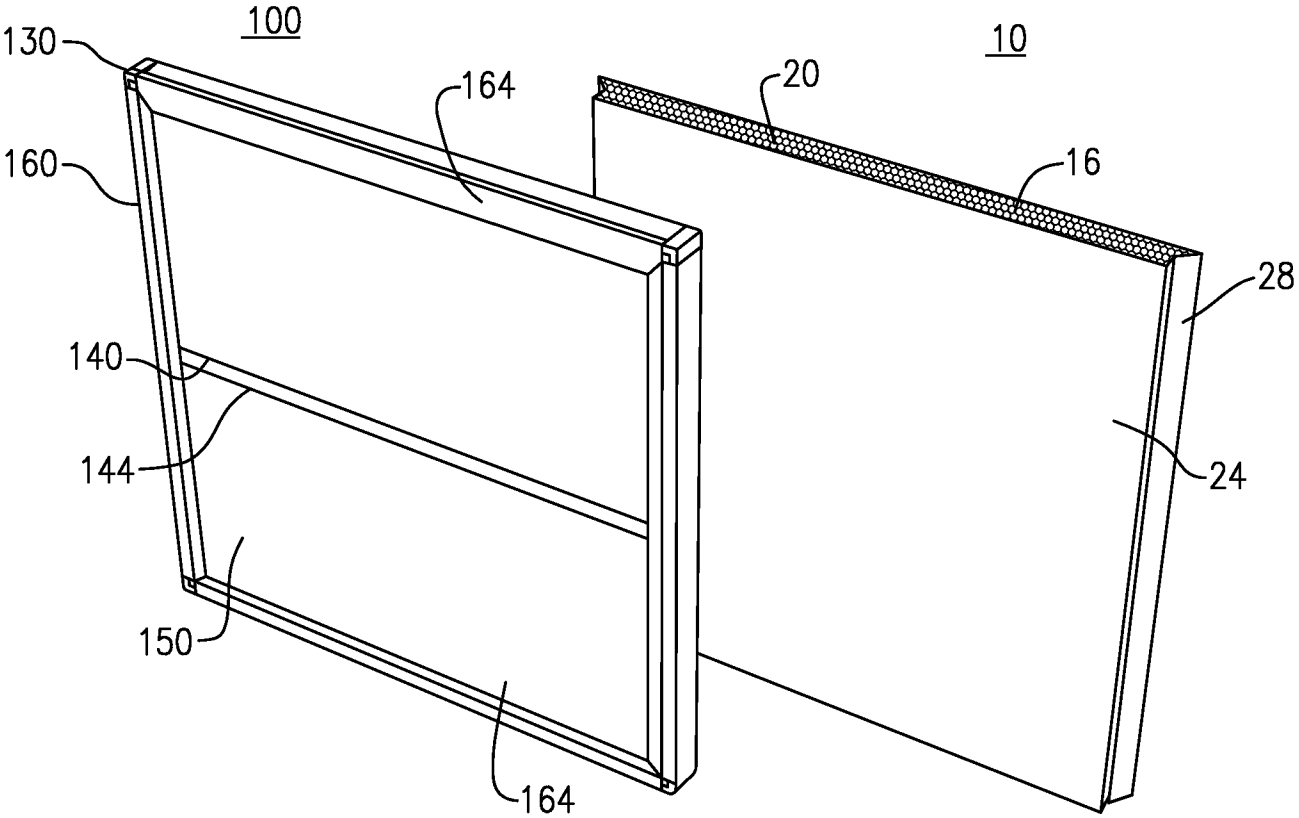
FIG. 1 is a perspective view which provides a side by side comparison of a prior art panel with a panel made in accordance with one embodiment of the present invention.

Referring to FIG. 1, there is first depicted a comparative illustration of a panel which is made in accordance with the prior art with a panel made in accordance with the exemplary embodiment of the present invention. First, a known wall panel 10 is defined by a substantially rectangular configuration and comprising three (3) major components; namely, a top layer 16, an intermediate core layer 20 and a backing layer 24. This panel 10 is marketed under the tradename of Whitewall in which the top layer 16 is made from a steel sheet having a ceramic or other suitable dry-erase coating layer that is applied to a front facing surface thereof. The application process and formulations of dry-erase coatings are not a part of the present invention, except in regard to the overall utility that is afforded by a dry-erase wall surface. Examples of same are described, for example, in U.S. Pat. Nos. 7,985,472 and 6,620,500, the contents of which are herein entirely incorporated by reference, as well as those developed by W.A. Krapf, Inc., of Macedon, N.Y., among others.

The intermediate core layer 20 is defined by a composite honeycombed material section, such as formed by paper or corrugated cardboard, which is appropriately sized to be fitted to the top layer 16, and the rear or backing layer 24 is made from a thin sheet of material, such as aluminum, that is sized to cover the intermediate core layer 20. In terms of assembly, the intermediate core layer 20 is adhered to the rear surface of the formed steel sheet. Lateral edge portions 28 of the front layer 16 are bent outwardly to permit overlap of multiple panels (not shown) and further to obscure the interior features of the formed panel 10. The rear backing layer 24 is also adhered to the intermediate core layer 20. As previously noted and when seeking to attach this panel 10 and/or a series of these panels to a wall surface (not shown), the rear backing layer 24 is permanently adhered thereto. Once attached, the position of the panel 20 cannot easily be adjusted or modified.

By contrast and in addition to other differences, the panel 100 made in accordance with the presently described embodiment includes a rear backing surface 150 permitting access to an intermediate insert or cleat 140. A longitudinal supporting slot 144 spans the width dimension of the cleat 140, the panel further including a frame 160 including a series of side trim sections 164 that are disposed between a core layer and lateral side edges of the panel 100 as discussed herein. The assembly of the panel 100 is now described in greater detail with reference to FIGS. 2-8.

Figure 2:
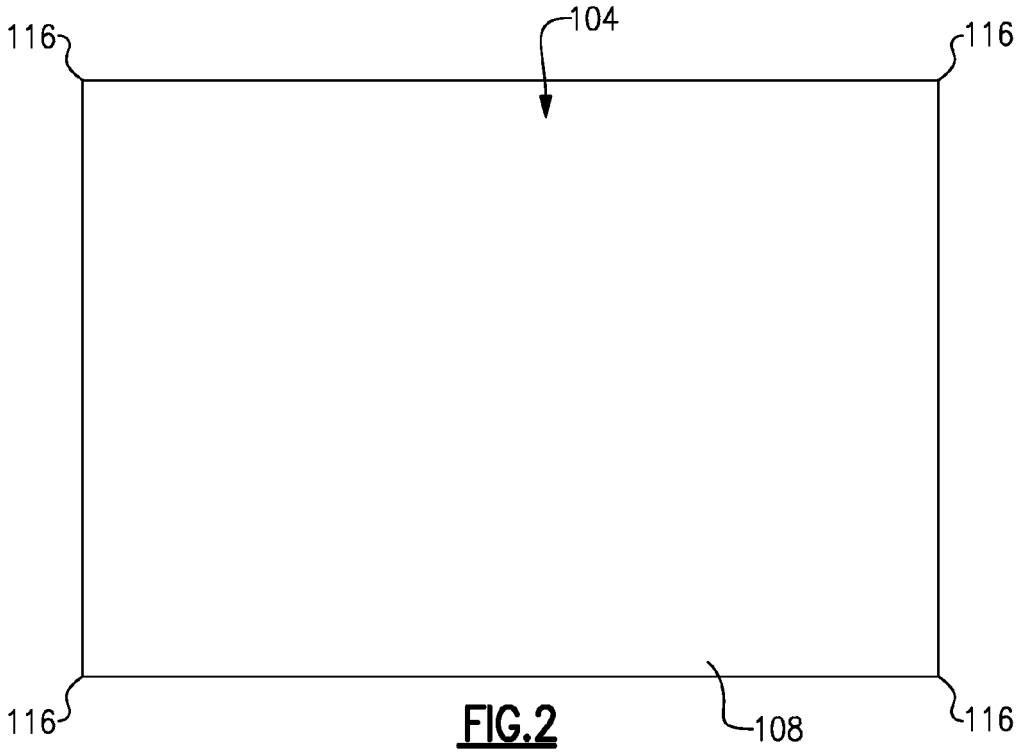
FIG. 2 is a perspective view of a steel sheet used as part of an initial step of panel manufacture in accordance with an exemplary embodiment.

According to a first step of manufacture, FIG. 2, a flat thin sheet 104 of steel is initially provided. Preferably and according to this embodiment, this sheet 104 already has a dry-erase coating that has been applied to a first or front side by means that are known in the field and in which the rear side 108 of the sheet 104 is herein exposed. According to this version, the entire front surface is provided with a suitable dry-erase coating, such as a polished ceramic coating as described for example, in U.S. Pat. Nos. 7,985,472 and 6,620,500, the contents of which have been herein entirely incorporated by reference, as well as those developed by W.A. Krapf, Inc., of Macedon, N.Y., among others. It will be readily understood that according to other versions, only a portion of the front surface can be provided with a dry-erase coating. In addition, other features can be inset within the front surface, such as columns, grids, rows, labels, headings, and the like.

Figure 3:
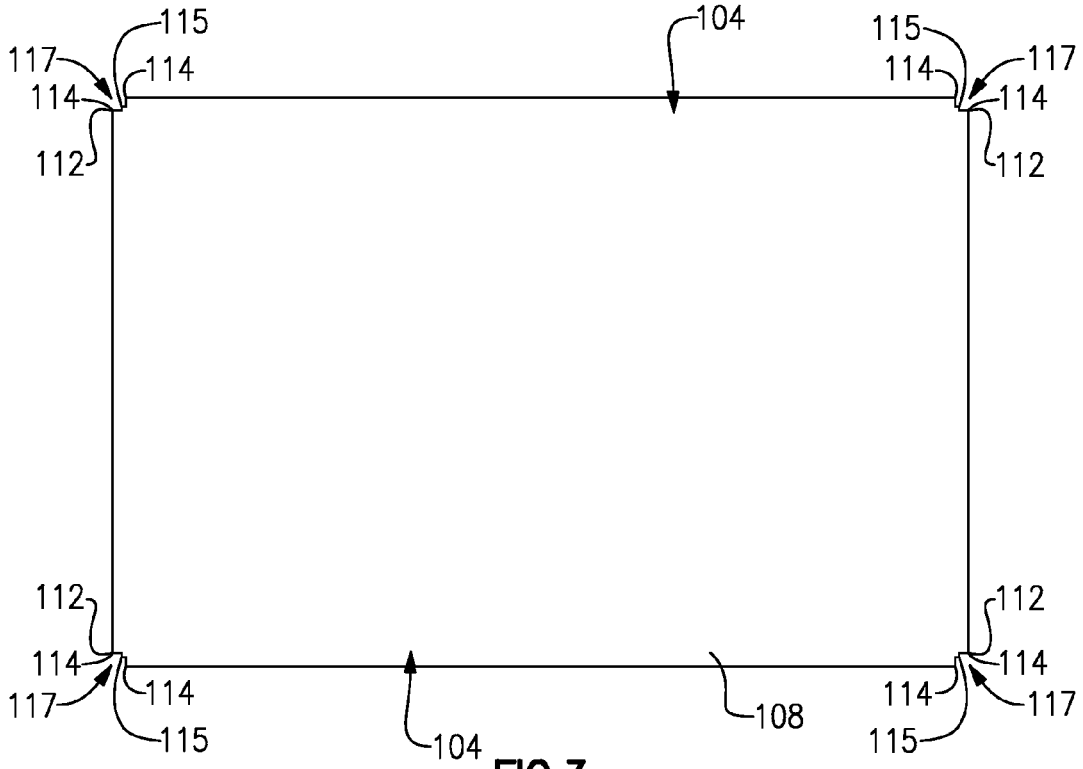
FIG. 3 illustrates the formation of notches in respective corners of the panel of FIGS. 1 and 2.

In a second step, shown in FIG. 3, notches 112 are then individually cut into each of the four corners of the formed steel sheet 104. These notches 112 are defined by orthogonal edges 114 that define grooves 117, the latter each extending inwardly to a protrusion 115 to enable the fitting of individual corner pieces 130, as discussed herein. These notches 112 can be inset into the sheet 104 using a sheet metal notcher or other appropriate metal forming tool.

Figure 4:
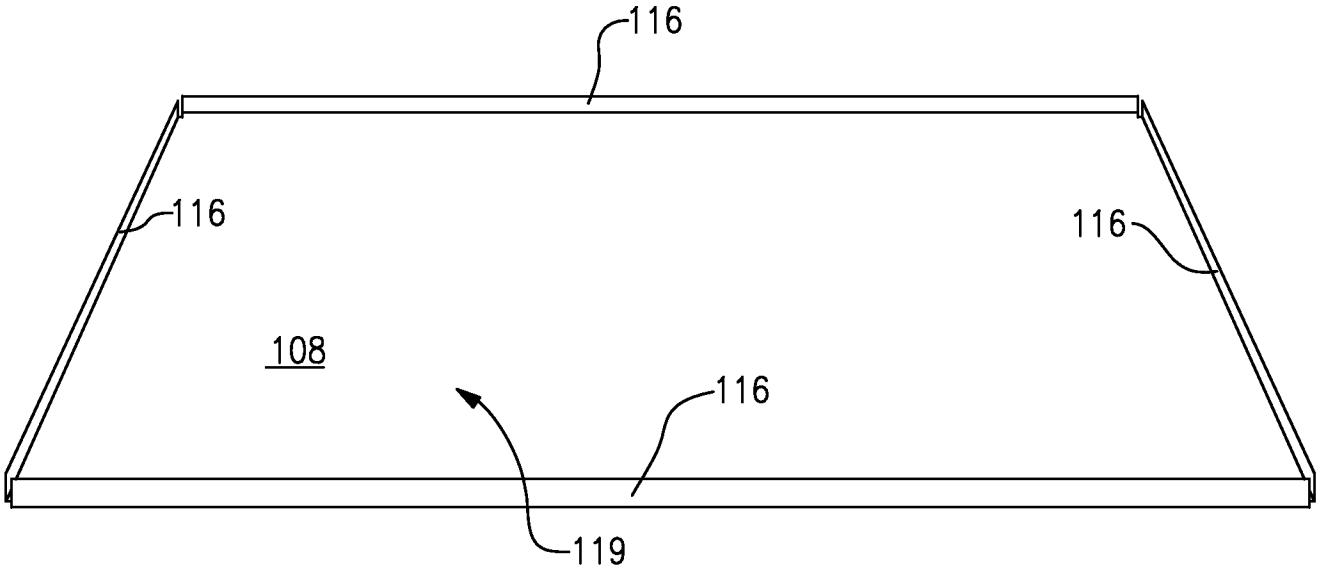
FIG. 4 illustrates the formation of lateral edge flanges relative to the panel of FIGS. 1-3.

Once the notches 112 have been formed and now referring to FIG. 4, a respective set of four (4) lateral or side flanges 116 of the steel sheet 104 are then foamed, such as through use of a suitable metal working apparatus, such as a finger brake or a press brake. Suitable examples of such apparatus capable of boxing the steel sheet are commercially sold by Mittler Bros and Baileigh Industrial, among others, the workings of these apparatuses being fairly well known to those in the field and not requiring further elaboration. Preferably and according to this embodiment, the lateral flanges 116 of the steel sheet 104 are flexed substantially perpendicular to the flat portion of the rear surface 108 thereof. Still more preferably and for reasons discussed herein, the lateral flanges 116 of the panel 100 are each retroflexed inwardly slightly less than 90 degrees relative to the rear surface 108. As such, an enclosure 119 defined by the lateral flanges 116 and the rear surface 108 of the panel 100 is formed.

Figure 5:
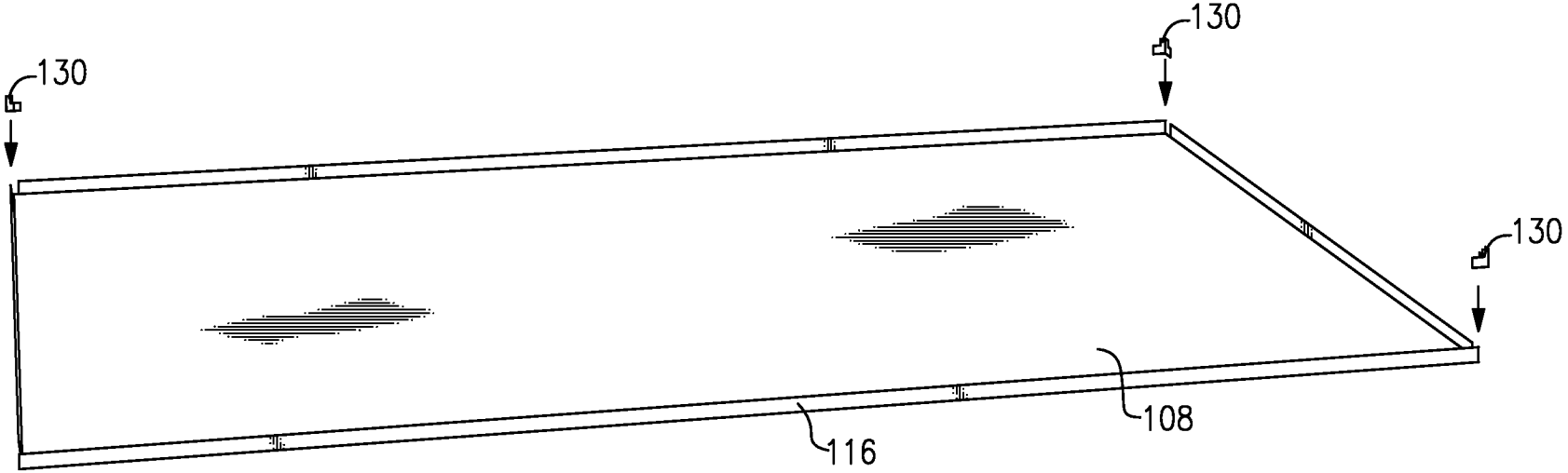
FIG. 5 illustrates the insertion of corner pieces into respective corners of the panel of FIGS. 1-4.

Referring to FIG. 5 and once the lateral flanges 116 have been formed as described, the individual corner pieces 130 are inserted to cover the spacing formed by the grooves 117 and the folded sheet 104 and creating a solid exterior perimeter for the panel 100. The corner pieces 130 include respective features that mate with the protrusion 115 and the orthogonal edges 114 when fitted within the grooves 117 defined by the formed flanges 116.

Figure 6:
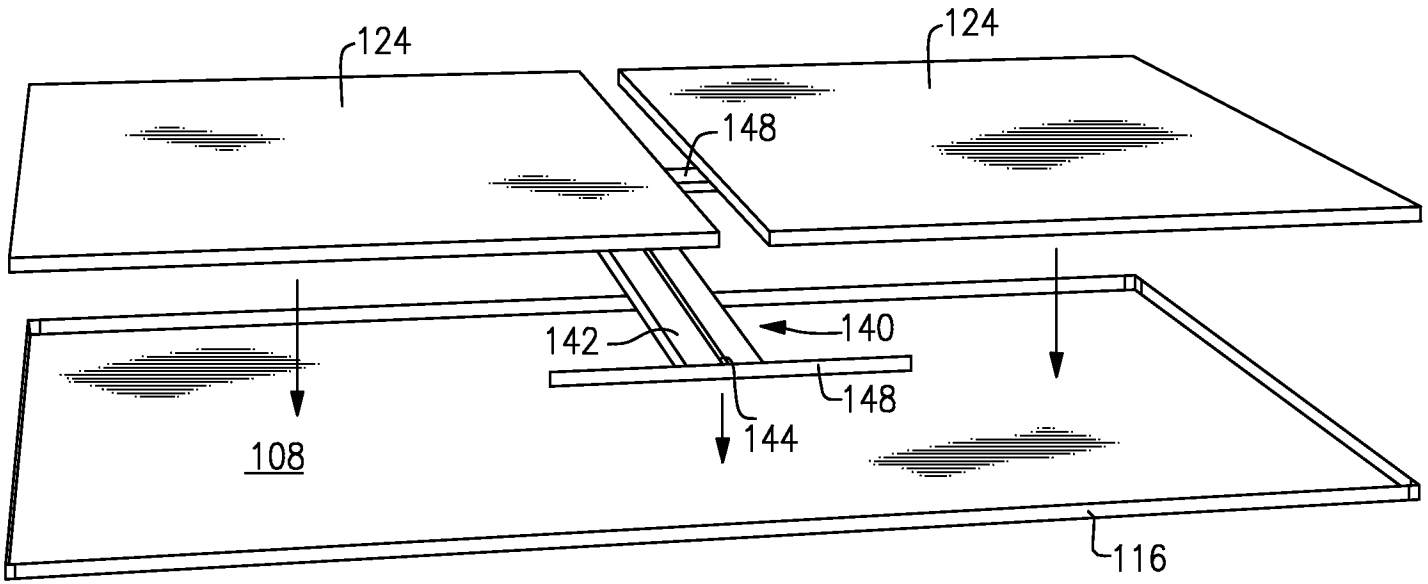
FIG. 6 illustrates the attachment of an intermediate substrate and a cleat mount in accordance with one embodiment to the panel of FIGS. 1-5.

Referring to FIG. 6, the cleat 140 can then be positioned in the center of the enclosure 119 formed by the lateral flanges 116 of the panel 100 and more specifically between two substrate sections 124 forming an intermediate core layer 120. According to the herein described embodiment, the substrate sections 124 of the core layer 120 are preferably made from a dense foam, such as polystyrene. Alternatively, the core could be defined by other filler materials, for example, such as corrugated honeycombed cardboard, that are capable of providing a structural backing for the steel top sheet of the panel. Each of the substrate sections 124 are adhered or otherwise secured to the rear surface 108 of the panel 100 and are sized to be fitted tightly within the formed enclosure 119 as to their width dimensions. As to the cleat 140 and according to this embodiment, this component is defined by an integrated structure that includes a body 142 made from wood, thickened plastic or other suitable material, and including a longitudinal supporting slot 144 extending substantially along the entire width dimension of the panel 100. According to this embodiment, opposing reinforcement rails 148 are formed on lateral sides of the cleat body 142. The reinforcement rails 148 can be integral to the cleat body 142 or can be attached thereto by means such as fasteners and the like and are used to provide reinforcement against buckling due to the discontinuity of the core layer 120 created by the introduction of the cleat 140. In passing and though the cleat 140 is introduced as a separate component for purposes of this embodiment, the cleat 140 could also be integral to the core layer in which a reinforcement rail would not be required. This latter feature may also not be needed depending on the overall size of the panel. As shown herein, the cleat 140 is effectively secured to the panel 100 by means of an interference fit between the substrate sections 124 and the lateral flanges 116 defining the formed enclosure 119.

Figure 7:
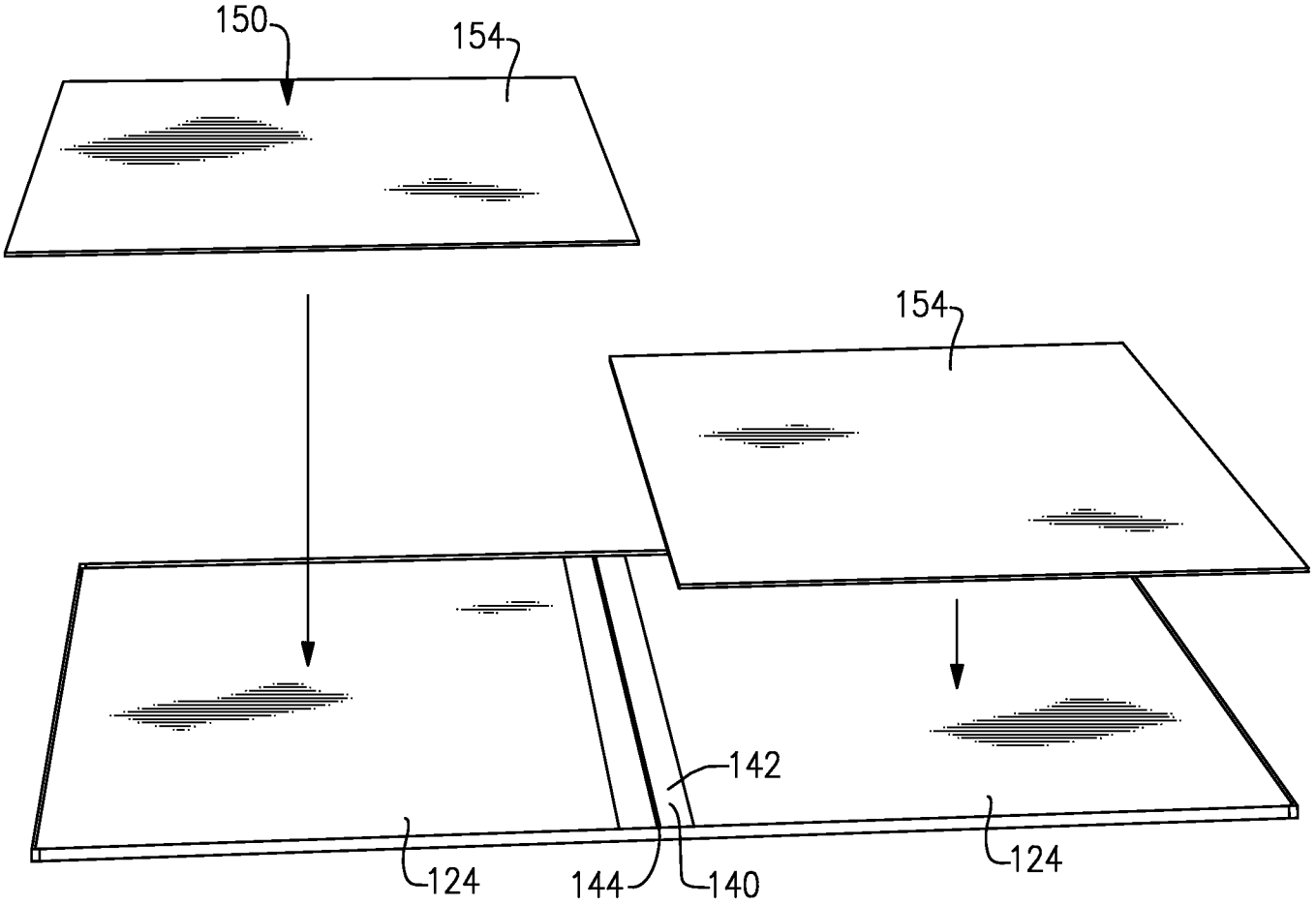
FIG. 7 illustrates the attachment of a backing surface to the panel of FIGS. 1-6.
Figure 8:
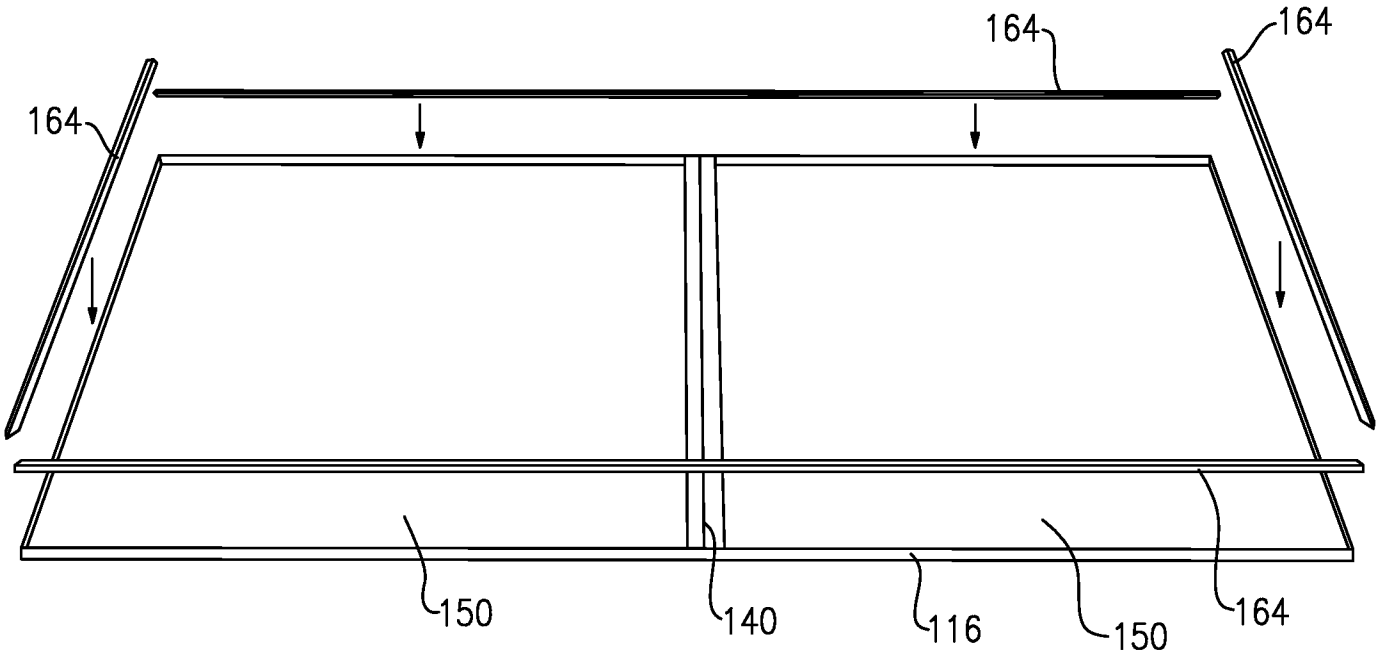
FIG. 8 illustrates the attachment of various sections of edge trim onto the lateral edges of the panel of FIGS. 1-7.
Figure 9:
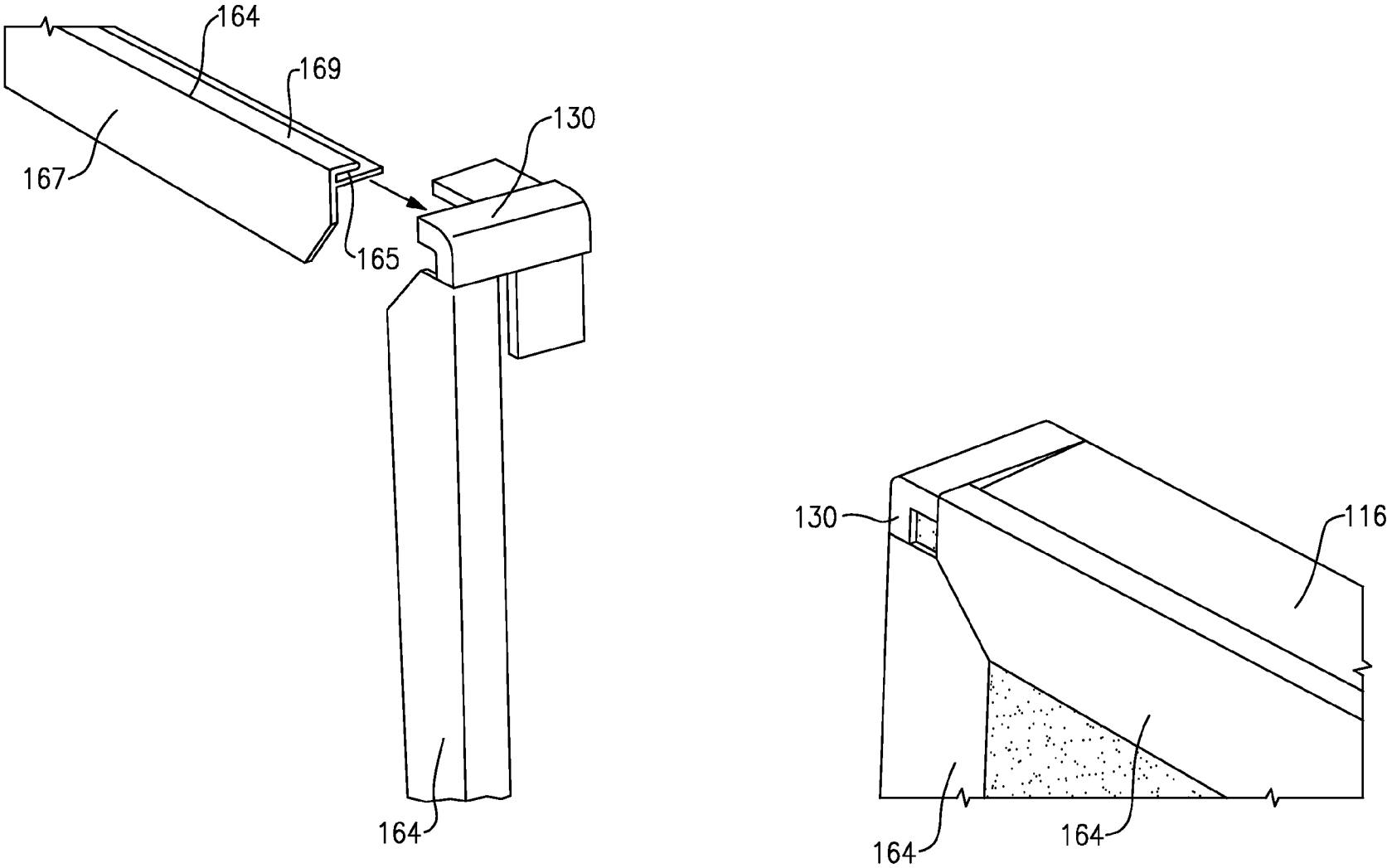
FIGS. 9 and 10 depict enlarged perspective views of the corner pieces of FIG. 5 in terms of attachment to the side trim of the panel of FIGS. 1-8.
Figure 10:
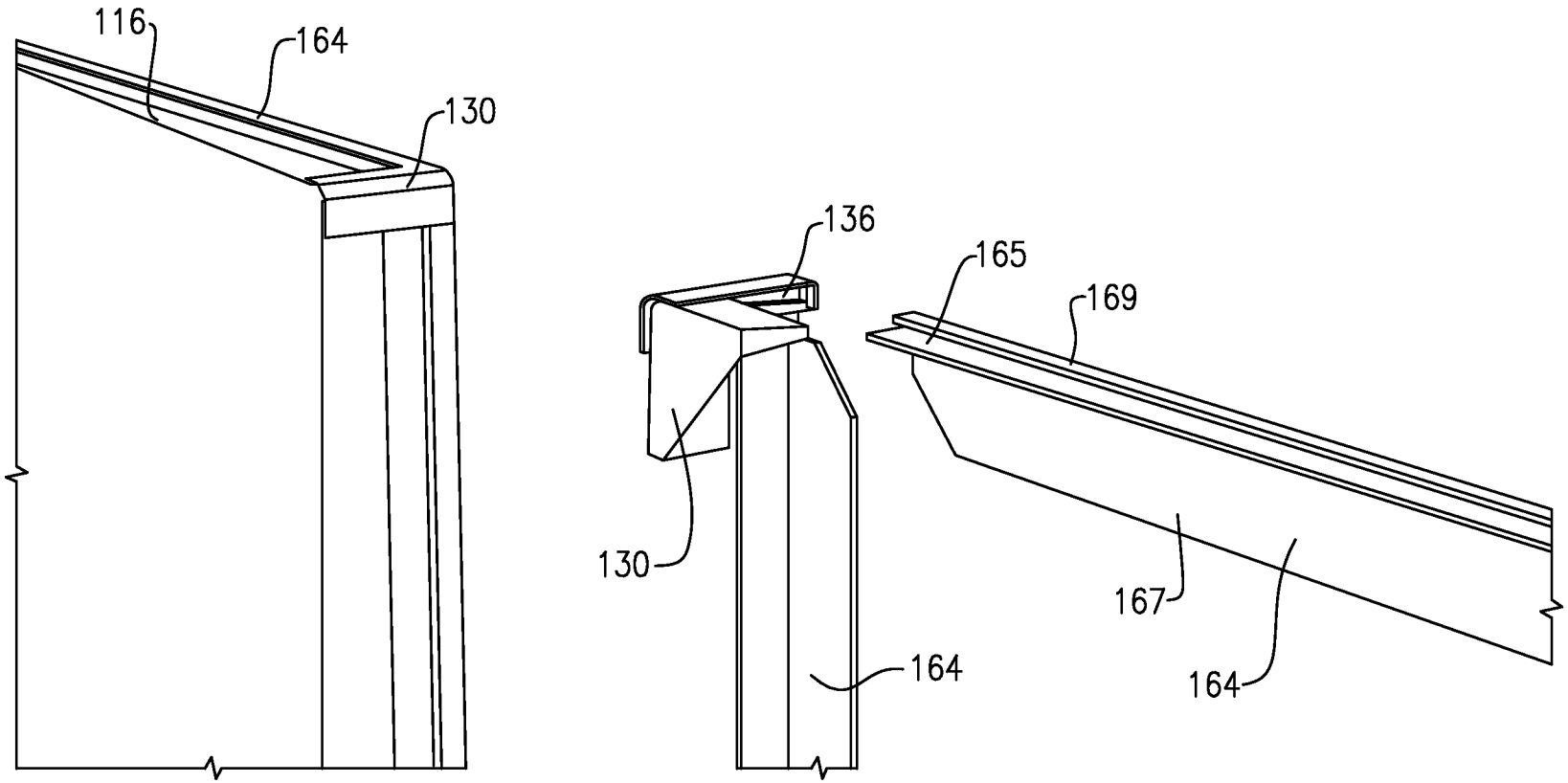

Referring to FIG. 7 and following assembly of the cleat 140, a rear backing layer 150 is secured to the rear side of the formed panel 100. The rear backing layer 150 according to this embodiment is made from a thin sheet of aluminum or similar material that includes an access slot, which when assembled is aligned with the supporting slot of the cleat 140. As shown herein, the access slot is effectively created by providing two adjacent sections 154 of the rear backing layer 150, as shown, which are disposed on opposing sides of the cleat 140, as shown in FIG. 8.

Referring to FIGS. 1 and 8-10, and according to this embodiment, a lateral edge trim 160 is added to the each of the four (4) sides of the formed panel 100 and more specifically between the steel sheet 104 and the intermediate core layer 120 thereof. The lateral edge trim 160 comprises four separate trim sections 164, each section including a first edge 167 that extends into the panel 100 and engages the lateral edge of the substrate sections 124 of the core layer 120. A second orthogonal edge 169 includes a groove 165 that receives a protrusion 136 formed in each of the corner pieces 130 and enables interconnectivity of the edge trim sections 164, as shown in the enlarged views of FIGS. 9 and 10.

Referring now to FIGS. 11-16, at least one formed panel 100, as discussed infra, can be releasably attached to a support structure 200, the latter being fixedly secured to a wall or wall structure.

Figure 11:
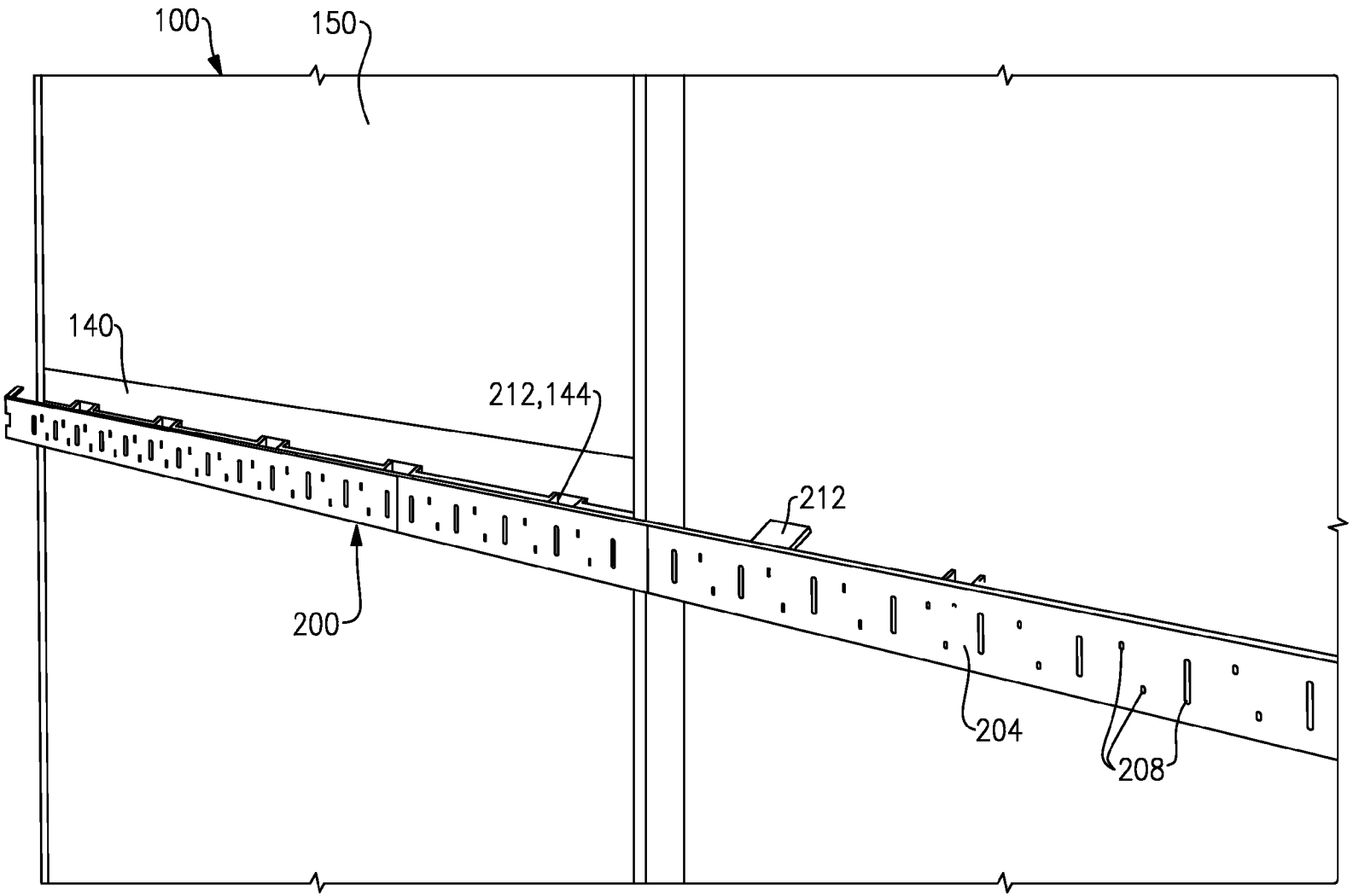
FIG. 11 is a partial rear facing view showing the attachment of a support structure to the panel of FIGS. 1-10.
Figure 13C:
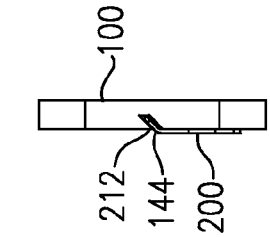
FIGS. 13(*a*)-(*c*) illustrate a sequence of attachment of a representative panel made in accordance with FIGS. 2-10 in relation to a support and wall structure.
Figure 13B:
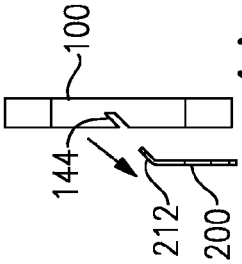
Figure 13A:
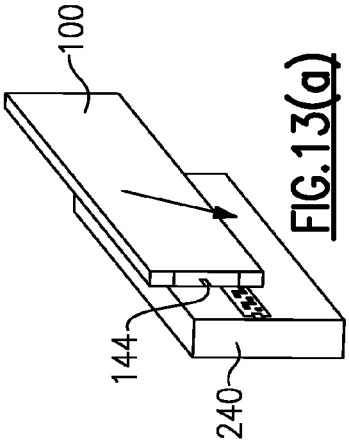
Figure 12:
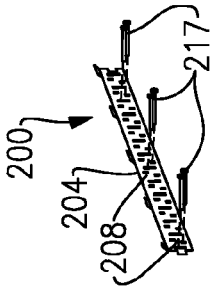
FIG. 12 is a rear perspective view of the support structure of FIG. 11, showing the reception of attachment members to enable the support structure to be anchored.
Figure 14:
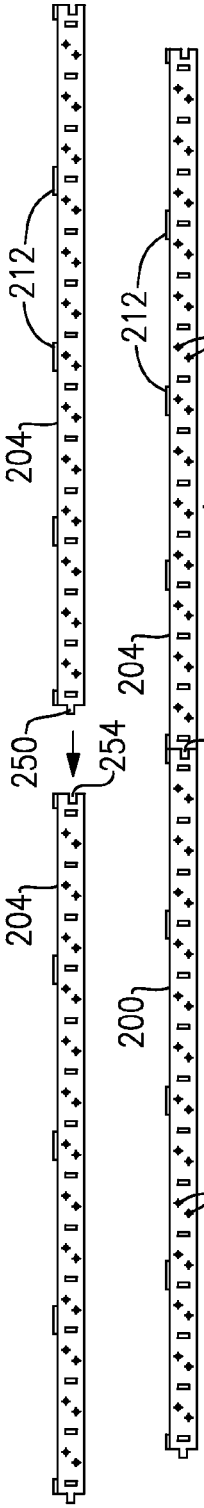
FIG. 14 depicts a front view of the support structure of FIGS. 13(*a*)-13(*c*), indicating the linear expandability thereof.

Referring to FIG. 11, the formed panel 100 can be attached to a support structure or support 200. As shown, the support 200 is defined by at least one planar section 204 made from a structural material, such as steel or other suitable material. The support 200 is further defined, according to this embodiment, by a plurality of spaced holes and slots 208 that permit the passage of fasteners 217 as shown in FIG. 12 to enable fixed attachment of the assembly to a wall surface 240 as shown in FIGS. 13(*a*)-13(*c*), the at least one planar section 204 including a plurality of spaced engagement members extending from an upper surface thereof. According to this embodiment, the spaced engagement members are tongues 212 that extend angularly upward from the support 200 and are configured, spaced and sized to engage the slot of the cleat 140 of the panel 100. When assembled to the wall surface 240, as shown in FIGS. 13(*a*)-13(*c*), the weight of the panel 100 is effectively distributed over the plurality of tongues 212 based on the relative spacing of the tongues. According to this embodiment, five (5) tongues engage the supporting slot 144 of the cleat 140 though the relative spacing between the tongues 212 can be suitably altered, as needed, to provide adequate support. As shown in FIGS. 11 and 14, the tongues 212 are integral and formed with the planar section 204. However, alternatively the engagement members (e.g., tongues) could be separately attached to the support structure 200 to provide additional versatility.

A single planar section 204 is shown in FIG. 11. However and as shown in FIGS. 14 and 15, a plurality of planar sections 204 can be interconnected together in linear serial fashion, each of the planar sections including respective male and female end engagement features 250, 254 enabling attachment thereto and permitting expandability of the assembly, as needed.

Figure 15:
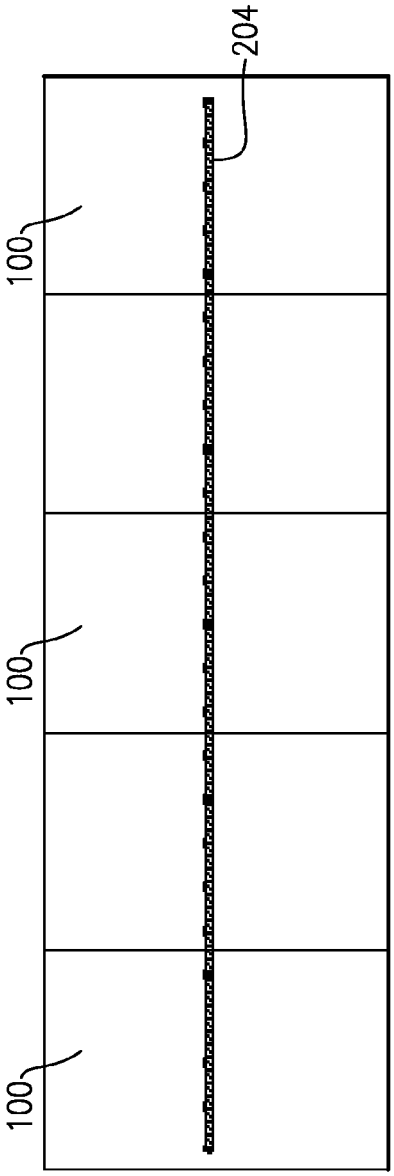
FIG. 15 depicts a rear facing view depicting a plurality of panels having a plurality of support structures releasably attached thereto.
Figure 16:
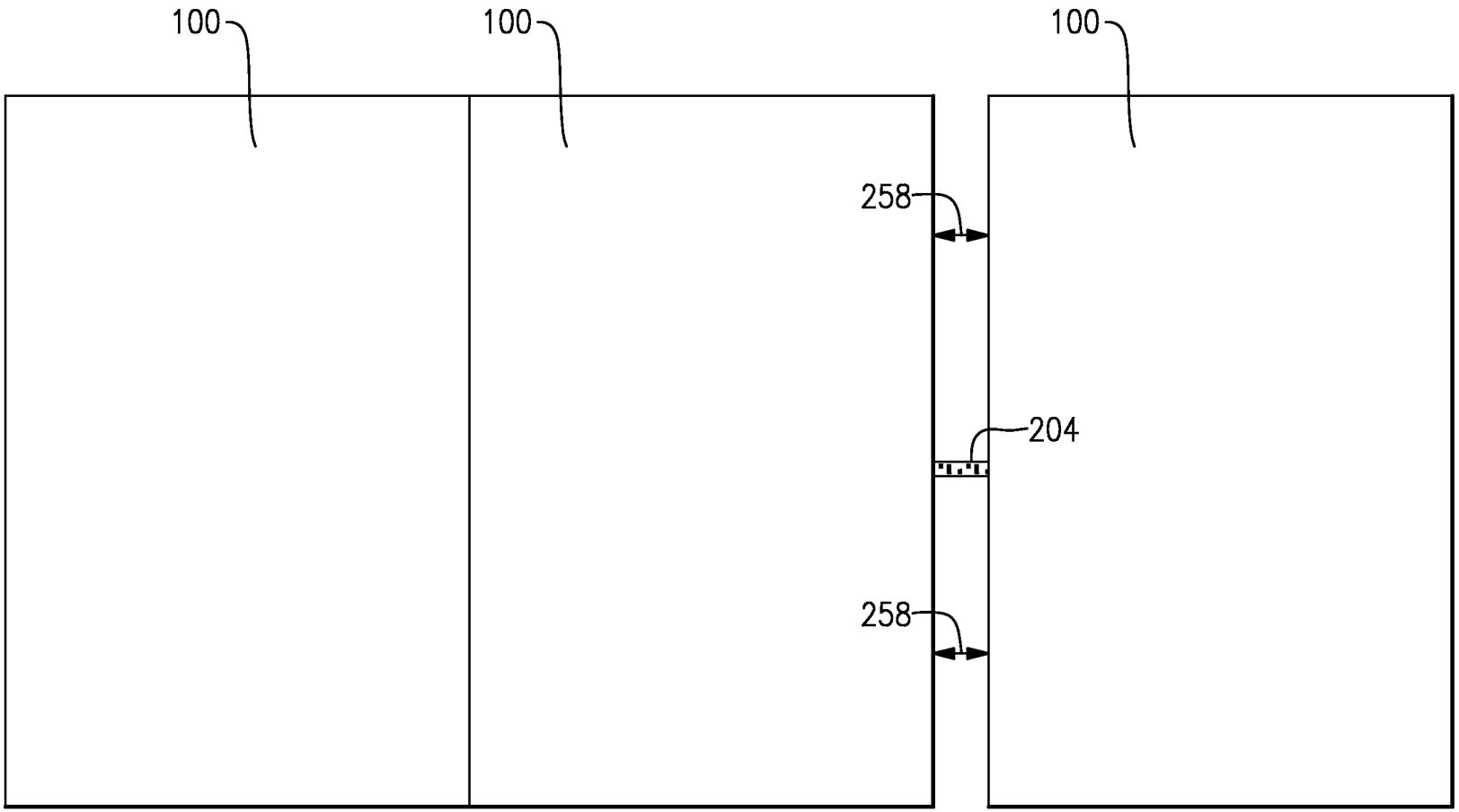
FIG. 16 is illustrates a front assembly view, depicting the variable spacing of the tongues of the support structure for fitting, for example, to the rear slot of the panel of FIGS. 2-10.

When releasably attached to a support structure 200, as shown in FIGS. 15 and 16, the panels 100 can be laterally adjusted to permit alignment with each other as needed, based on the spacing of the tongues 212 and the extensive supporting slot 144 of the cleat 140 and as shown by arrow 257. According to another version, the slot 144 can be abbreviated as to its length, although it is preferred the supporting slot extend over substantially the width dimension of the panel 100 to maximize adjustability. The number and spacing of the tongues 212 can also be suitably adjusted to better support loads and also increase adjustability of one or a plurality of supported panels 100 in the assembly. By retroflexing the lateral flanges 116 of the panels 100, an improved fit is naturally created relative to the lateral edge trim 160.

Moreover and by presetting the support structure 200 and leveling same relative to the wall structure first, wall panels can then be added in which engagement of the tongues with the cleat slots of the panel permit planar alignment of one or a plurality of panels whether the panels are releasably attached to the wall by virtue of the support structure or for permanently adhering the panels to the wall or wall structure.

Parts List for FIGS. 1-16

10 panel
16 front surface or side
20 intermediate core layer
24 rear backing layer
28 bent shape, panel
100 panel
104 sheet, steel
108 rear side, sheet
112 notches
115 protrusion
116 lateral flanges, rear extending
117 grooves
119 enclosure, formed
120 intermediate core layer
124 substrate sections
130 corner pieces
136 projections
140 cleat
142 cleat body
144 longitudinal supporting slot
148 reinforcement rails, opposing
150 frame
154 side edges
160 edge trim
164 edge trim section
165 groove
167 first edge
169 second edge
200 support or support structure
204 support section
208 spaced holes and slots
212 spaced tongues
217 fasteners
240 wall surface
250 engagement feature
254 engagement feature
257 arrow It will be readily apparent that there are numerous variations and modifications that can be made within the spirit and scope of the inventive concepts described herein and according to the following claims.

The invention claimed is:

1. A system for assembling at least one dry-erase display panel to an existing wall surface, the system comprising:

at least one wall panel comprising:

a single steel sheet having a front facing dry-erasable writing surface and a set of integral bent rear extending side edge flanges forming an enclosure;

an intermediate core layer comprising a pair of substrate sections fitted within the formed enclosure, said substrate sections each having a front surface attached to a rear surface of the single steel sheet and an exposed rear surface, said substrate sections further including a pair of opposing side edges forming a spacing therebetween of the core layer; and a cleat fitted within the formed spacing between the substrate sections of the intermediate core layer, said cleat including a cleat body having at least one longitudinal slot, the cleat forming a center portion of the intermediate core layer engaging the opposing side edges of the substrate sections within the formed spacing and combined with the exposed rear surfaces of the substrate sections defining a rear surface of the at least one wall panel, opposite the front facing dry-erasable writing surface, wherein rear surfaces of the cleat and the substrate sections are coplanar to one another and wherein the at least one longitudinal slot extends inwardly from the rear surface of the at least one wall panel toward the rear facing side of the single steel sheet; and a support having means for enabling said support to be fixedly attached to the existing wall surface, said support including a plurality of spaced engagement members engageable with the at least one longitudinal slot of said at least one wall panel.

2. A system as recited in claim 1, wherein said engagement members comprise a plurality of spaced tongues.

3. A system as recited in claim 2, wherein said tongues are integral to said support.

4. A system as recited in claim 2, wherein said tongues are angled relative to the remainder of said support.

5. A system as recited in claim 1, including a plurality of supports, said supports including end features enabling linear attachability to one another.

6. A system as recited in claim 5, wherein said at least one longitudinal slot is angled for engaging said tongues.

7. A system as recited in claim 1, wherein said cleat includes at least one edge section transverse to the at least one longitudinal slot and engageable with the side flanges of the panel for reinforcing said panel.

* * * * *